United States Patent [19]

Kahl et al.

[11] Patent Number: 5,040,834

[45] Date of Patent: Aug. 20, 1991

[54] LOCKABLE LATCH FOR A CONTAINER

[75] Inventors: W. Henry Kahl, Wooster, Ohio; Raymond B. Ferbrache, Winfield, Kans.

[73] Assignee: Rubbermaid Incorporated, Wooster, Ohio

[21] Appl. No.: 619,879

[22] Filed: Nov. 29, 1990

[51] Int. Cl.[5] ..... E05C 3/14

[52] U.S. Cl. ..... 292/204; 292/205; 292/286; 292/104; 292/DIG. 38; 220/315; 220/324

[58] Field of Search ..... 292/204, DIG. 38, 205, 292/300, 104, 282, 283, DIG. 11, DIG. 30, DIG. 42, 284, 286; 220/315, 324; 70/56

[56] References Cited

U.S. PATENT DOCUMENTS

| | | | |
|---|---|---|---|
| D. 158,368 | 5/1950 | Felts et al. | D58/12.6 |
| D. 232,129 | 7/1974 | Evans | D87/1 R |
| D. 246,548 | 11/1977 | Uyeda | D87/1 R |
| 429,510 | 6/1890 | Davy et al. | 292/285 |
| 740,732 | 10/1903 | Beehler | 292/104 X |
| 968,222 | 8/1910 | Williams | 292/104 X |
| 2,812,102 | 11/1957 | Caplinger | 220/324 |
| 3,181,905 | 5/1965 | Bisbing | 292/101 |
| 3,466,076 | 9/1969 | Bisbing | 292/109 |
| 3,490,805 | 1/1970 | Di Pierro et al. | 292/DIG. 38 |
| 3,572,062 | 3/1971 | Beebe | 292/205 |
| 3,606,511 | 9/1971 | Henning et al. | 312/266 |
| 3,713,681 | 1/1973 | Worley | 292/78 |
| 3,985,409 | 10/1976 | Kneier | 312/271 |
| 3,998,481 | 12/1976 | Anthone | 292/104 |
| 4,023,840 | 5/1977 | Souza et al. | 292/113 |
| 4,118,086 | 10/1978 | Kneier | 312/270 |
| 4,249,760 | 2/1981 | Conley | 292/197 |
| 4,331,257 | 5/1982 | Taschner | 220/324 |
| 4,501,378 | 2/1985 | Berfield | 220/324 |
| 4,502,715 | 3/1985 | Lundblade | 292/78 |
| 4,540,206 | 9/1985 | Frame et al. | 292/66 |
| 4,643,494 | 2/1987 | Marleau | 312/111 |
| 4,662,515 | 5/1987 | Newby, Sr. | 206/349 |
| 4,705,308 | 11/1987 | Bisbing | 292/108 |
| 4,775,199 | 10/1988 | Lanius et al. | 312/220 |
| 4,828,298 | 5/1989 | Bisbing | 292/113 |
| 4,879,889 | 11/1989 | DeForrest, Sr. | 292/281 |

FOREIGN PATENT DOCUMENTS

| | | | |
|---|---|---|---|
| 2411777 | 8/1979 | France | 220/324 |

OTHER PUBLICATIONS

Nielsen Hardware, Hartford, Conn.; one page sell sheet.
Delta, Inc. of Arkansas, P.O. Box 1846, Jonesboro, Ark.; 2 page brochure.
Delta, Inc. of Arkansas, P.O. Box 1846, Jonesboro, Ark.; one page POLY HOPPER brochure.
Contico Automotive, Div. of Contico International, Inc., St. Louis, Mo.; 2 page WORKBOX brochure; 1990.
Contico Manufacturing Company, St. Louis, Mo.; one page TUFF CHEST brochure.
Plano Molding Company, P.O. Box 189, Plano, Ill.; 13 pages, 1989 catalog.
Flambeau Products Corporation, 15981 Valplast Rd., Middlefield, Ohio; 12 page, 1989 catalog.
Contico, St. Louis, Mo.; 14 page, 1989 catalog.

(List continued on next page.)

*Primary Examiner*—Eric K. Nicholson
*Assistant Examiner*—Darnell M. Boucher
*Attorney, Agent, or Firm*—Renner, Kenner, Greive, Bobak, Taylor & Weber

[57] ABSTRACT

A container (10) includes a base portion (12), a cover (11) and a latch assembly (13) for releasably attaching the cover (11) to the base portion (12). The latch assembly (13) includes a latch body portion (24) having lower upper end (27) pivotally connected to the base portion (12) and an upper end (26) carrying lug members (36) which can engage a rib (37) on the cover (11). A lock receiving tab (40) extends outwardly from the cover (11) and is positioned adjacent to a slot opening (42) in the latch body portion (24) when the latch assembly (13) is engaging the cover (11). In this position, a lock can be positioned through the slot opening (42) and through an opening (41) in the tab (40) to lock the latch assembly (13) and thus the cover (11) on the base portion (12).

22 Claims, 2 Drawing Sheets

OTHER PUBLICATIONS

The Disston Company; 3 page ROUGH-HOUSE brochure; 1989.

MTM Molded Products Company, P.O. Box 14117, Dayton, Ohio; 2 page TOOL GARD brochure.

Rubbermaid Incorporated, Wooster, Ohio; 2 page DESIGN-A-SPACE brochure; 1986.

GSC Technology Corporation, Champlain, N.Y.; one page BENCHMASTER brochure.

EKCO Specialty Products, 165 W. Chicago Ave., Chicago, Ill.; 8 page TOOL SHED brochure; 1989.

LOCKABLE LATCH FOR A CONTAINER

TECHNICAL FIELD

This invention relates to a latch for a container. More particularly, this invention relates to a combined latch and lock receiving mechanism so that the container can be locked at the area of the latch.

BACKGROUND ART

Many containers, such as ice chests, tool boxes, general storage containers and the like, are provided with releasable latches to maintain a cover on the body portion of the container. By snapping or otherwise manipulating the latch or latches to a released position, the cover may be opened to gain access to the contents of the container.

It is often desirable, and known in the art, to provide many such containers with a lock receiving mechanism for use with a padlock or the like so that the container may not be opened even if the latch is released. Such lock receiving mechanism can, for example, take on the form of mating tabs which extend outwardly from the container base and cover through which a padlock may be positioned. However, such an obtrusive mechanism not only can detract from the overall appearance of the product, but also it can be easily bumped or damaged or itself can bump or damage something that it may contact. Moreover, containers having such outwardly extending lock receiving mechanisms cannot be conveniently stored in a confined area. Finally, such mechanisms do not immobilize the latch, if that be desired.

It has been suggested that, to eliminate the obtrusive nature of the prior art lock receiving mechanisms, the mating surfaces could be positioned within recesses formed in the cover and the base. While such positioning does provide a solution to some of the problems, not only does forming the required recesses potentially add costs to manufacturing the product, but also valuable storage space within the container can be lost.

DISCLOSURE OF THE INVENTION

It is thus a primary object of the present invention to provide a latch assembly for a container which includes both a latch mechanism and a lock receiving mechanism.

It is another object of the present invention to provide a latch assembly, as above, in which the lock receiving mechanism does not obtrusively extend outward from the overall profile of the container.

It is a further object of the present invention to provide a latch assembly, as above, in which the latch is essentially immobilized when a lock is applied to the lock receiving mechanism.

It is an additional object of the present invention to provide a latch assembly, as above, in which the lock receiving mechanism is protected from damage.

It is a still further object of the present invention to provide a latch assembly, as above, for a container which is not required to have any special or additional recesses for the lock receiving area.

It is another object of the present invention to provide a latch assembly, as above, with a means to readily attach the container to another object or selectively to store a padlock when it is not in use.

It is yet another object of the present invention to provide a latch assembly, as above, with a lock receiving mechanism which does not detract from the facile storage of the container.

These and other objects of the present invention, as well as the advantages thereof over existing prior art forms, which will become apparent from the description to follow, are accomplished by the means hereinafter described and claimed.

In general, a latch assembly releasably attaches a container cover to a container base and includes a body member having a lower end pivotally attached to the container base. Lug members near the upper end of the body member can releasably engage the container cover. A lock receiving tab extends outwardly from the container cover and is aligned with an aperture in the body member when the body member is in a closed position with the lugs engaging the container cover. A lock may then be inserted through the aperture in the body member and engage the lock receiving tab.

A preferred exemplary latch assembly incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
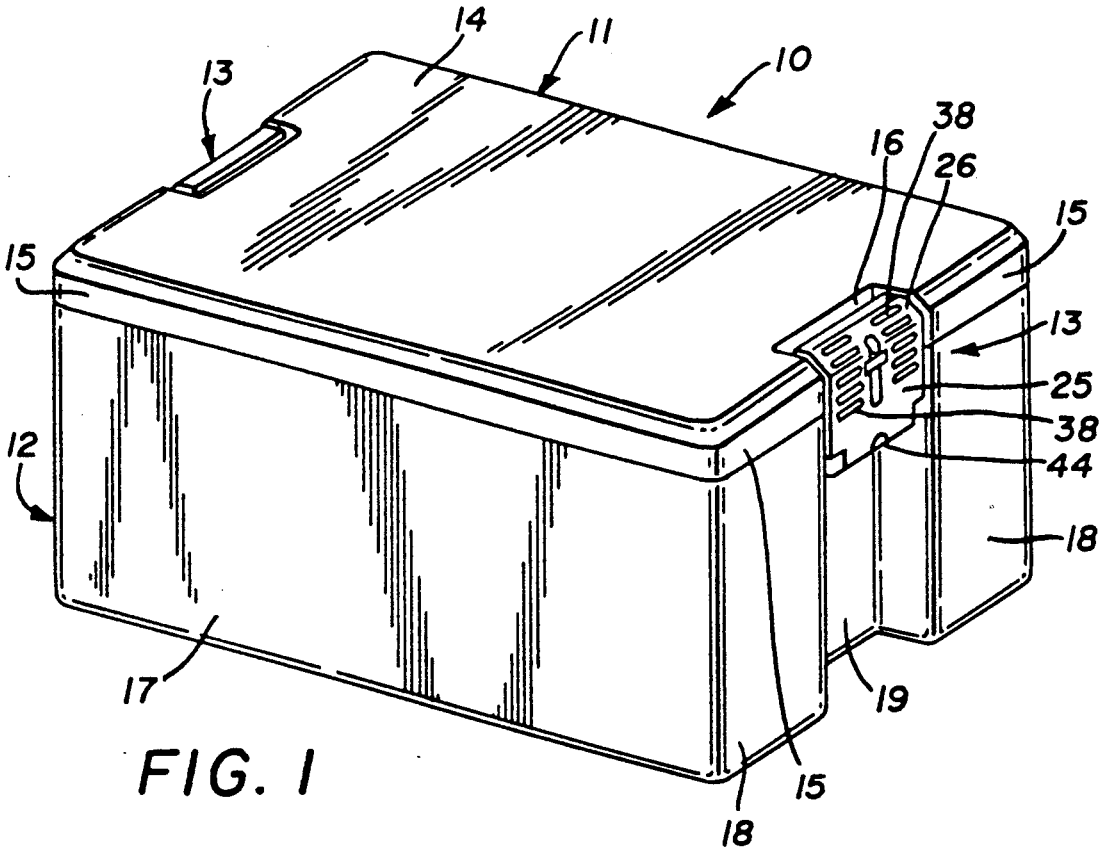
FIG. 1 is a perspective view of a container having two latch assemblies according to the concepts of the present invention.

A container is generally indicated by the numeral 10 in FIG. 1 and includes a cover portion generally indicated by the numeral 11 and a base portion generally indicated by the numeral 12. Cover 11 is shown as being selectively attached to or releasable from base portion 12 by means of two latch assemblies constructed according to the concepts of the present invention and generally indicated by the numeral 13. While two identical latch assemblies 13 are shown, it will become apparent that any number of latch assemblies may be provided for any type of container without departing from the spirit of this invention. For example, a container 10 could be provided with two additional latch assemblies along the sides thereof in addition to the two assemblies 13 shown on the ends of container 10 in FIG. 1. Similarly, only one latch assembly 13 may be utilized with the side of the cover 11 opposite to the single latch assembly being hinged to base 12, in a conventional manner, or even being provided with a conventional latch instead of the latch assembly according to the present invention.

Likewise, latch assembly 13 can be utilized with containers of essentially all configurations with container 10 being depicted merely to show the environment for latch assembly 13. In container 10 as shown, cover 11 is depicted as having a relatively planar top surface 14 with downturned peripheral skirts 15 along the sides and ends thereof. Top surface 14 and skirts 15 on the ends of cover 11 are shown as having a recess 16 to receive latch assembly 13 in a manner to be hereinafter described. Base portion 12 is shown as having generally vertical planar side walls 17 and generally vertical planar end walls 18 which are interrupted or recessed, as at 19, to complement recess 16 and provide a recessed location for latch assembly 13.

Figure 4:
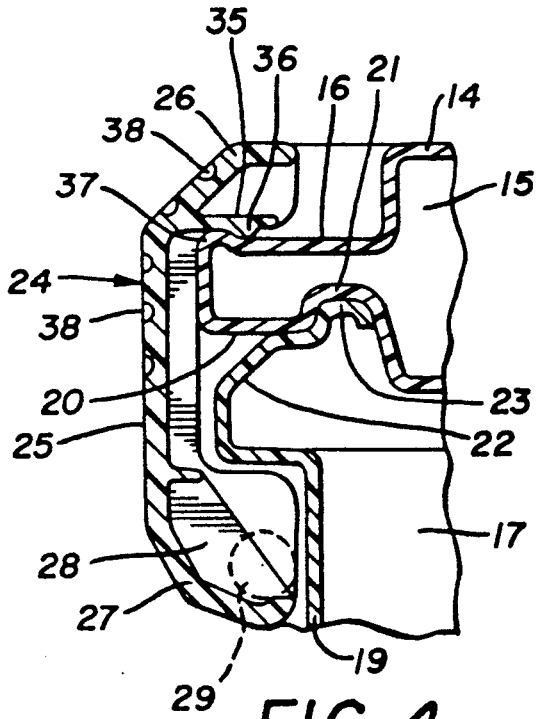
FIG. 4 is a fragmented sectional view taken substantially along line 4—4 of FIG. 3.

Although the specific manner in which cover 11 and base portion 12 mate with each other is unimportant to this invention, one such manner is shown in FIG. 4. Downturned skirt 15 of cover 11 turns back on itself, as at 20, and forms a recessed ledge 21 under the entire periphery of cover 11. Similarly, the top of base portion 12 both on side walls 17 and end walls 18, as well as at the top of recess 19, turn back, as at 22, and form an upper lip 23 around the entire periphery of base portion 12. Ledge 21 of cover 11 therefore rests on lip 23 of base portion 12 to close cover 11 on base portion 12.

Having described the rather conventional details of container 10, a latch assembly 13 will now be described in detail. Latch assembly 13 includes a generally C-shaped body portion generally indicated by the numeral 24, having a main generally planar central portion 25, an upper portion 26, and a lower portion 27. Upper and lower portions 26, 27, while being made up of somewhat planar surfaces, take on an overall curvilinear configuration forming the top and bottom of the C-shaped body portion 24 thereby extending inwardly from central portion 25 toward container 10.

The laterally outer edges of lower curvilinear portion 27 are provided with inwardly directed support flanges 28 which carry split axles 29 (FIG. 3) extending laterally outwardly therefrom. If latch assembly 13 is made of plastic, as is preferred, assembly 13 may be provided with a horizontal support rib 30 extending between flanges 28 and a plurality of vertical strengthening ribs 31 extending between rib 30 and the inside of lower portion 27 of latch body portion 24. Bearing hubs 32 having retaining heads 33 extend through the walls forming recess 19 and receive axles 29 therethrough. Axles 29 may be pushed through hubs 32 and a retaining ring 34 (FIG. 3) molded around the split axles 29 retains axles 29 against heads 33 of bearing hubs 32. Thus, body portion 24 can be rotated on axles 29 from the open position shown in FIG. 2 to the closed position shown in FIGS. 1 and 3 and vice versa. It should be noted that when in the closed position, latch assemblies 13 double as handles for container 10 as one merely needs to grasp underneath lower curvilinear portion 27 at the area within recess 19 to conveniently lift and transport container 10.

Figure 2:
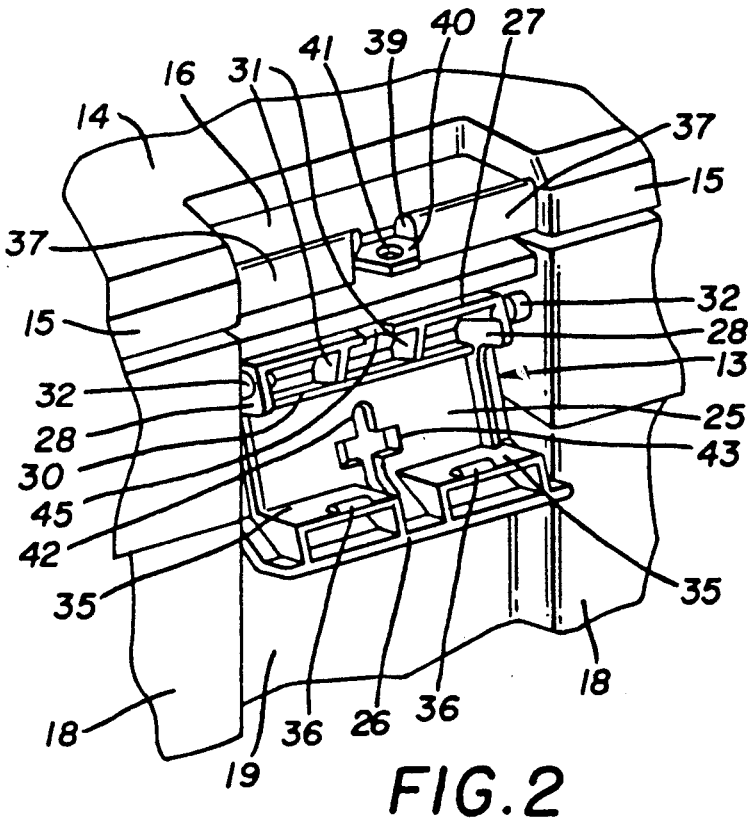
FIG. 2 is an enlarged fragmented perspective view showing a latch assembly of the container of FIG. 1 in an open position.
Figure 3:
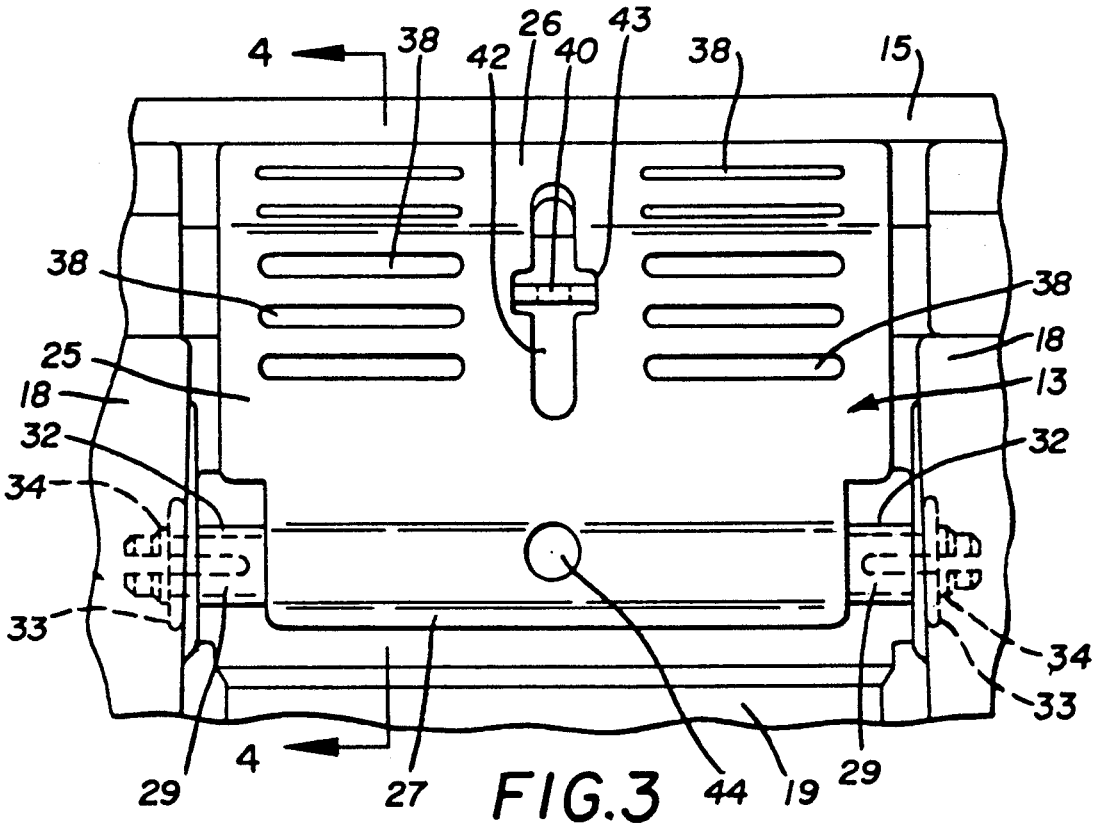
FIG. 3 is an enlarged fragmented elevational view showing a latch assembly of the container of FIG. 1 in a closed position.

As shown in FIG. 2, upper curvilinear portion 26 of body portion 24 is provided with two, spaced, internally projecting U-shaped brackets 35, each of which carries a lug 36 Lugs 36 are adapted to engage a rib 37 which extends across recess 16 of cover 11 near the laterally outer edge thereof. As such, when latch body portion 24 is moved from the open position to the closed position, lugs 36 snap over rib 37 and frictionally engage rib 37 to maintain cover 11 on body portion 12. Horizontal gripping recesses 38 may be provided in the outer surface of body portion 24, as shown in FIG. 3, to assist in gripping latch assembly 13.

As shown in FIG. 2, rib 37 is interrupted, as at 39, and a lock receiving tab 40 having an aperture 41 therethrough extends outwardly from cover 11 at the point of interruption 39. Latch body portion 24 is provided with a generally centrally located vertical slot 42 extending from central planar portion 25 and upwardly into upper portion 26. Central planar portion 25 is also provided with a cross slot 43 extending generally horizontal to and centrally of vertical slot 42. When latch assembly 13 is in the closed position, cross slot 43 is aligned with lock receiving tab 40, the portion of slot 42 in central portion 25 is immediately below tab 40, and the portion of slot 42 in upper portion 26 is above and over tab 40 (because of the curvilinear nature of upper portion 26). As such, a conventional padlock, for example, can be threaded through the portion of slot 42 in upper portion 26, through aperture 41 in tab 40, and through the portion of slot 42 in central portion 25. Upon locking the padlock in this position, lugs 36 cannot be disengaged from rib 37 and thus cover 11 is locked on body portion 12. It should be noted that when in the closed and locked position, all surfaces of latch assembly 13, including lock tab 40, are recessed within cover recess 16 and recess 19 formed in the end walls 18 of body portion 12 of container 10.

As an additional feature, lower curvilinear portion 27 of latch body 24 may be provided with an aperture 44 extending therethrough. As shown in FIG. 2, the lower edge of lower curvilinear portion 27 is notched, as at 45. Notch 45 is generally aligned with aperture 44 and together aperture 44 and notch 45 can serve several functions. For example, if it is desired to tie down container 10, as in the back of a truck, one end of a conventional bungee cord can be passed through aperture 44 and the bungee cord hook can engage notch 45. Moreover, to store a padlock when not in use, the padlock may be extended through aperture 44 and within notch 45 and locked in place. Notch 45 thereby serves to keep the padlock from distractingly swinging within aperture 44. Aperture 44 also provides latch assembly 13 with an additional lock feature; that is, instead of a padlock, a conventional cable lock can be utilized by threading the cable through apertures 41 and 44, and once cinched and locked in place, latch assembly 13 is thereby locked.

It should thus be appreciated that a latch assembly constructed according to the concepts of the present invention, as described herein, accomplishes the objects of the invention and otherwise substantially improves the container latch art.

We claim

1. A latch assembly for attaching a container cover to a container base portion comprising a generally C-shaped body member having a generally planar portion between generally curvilinear upper and lower ends, means proximate said lower end of said body member to pivot said body member with respect to the container base portion, lug means proximate said upper end of said body member to engage the container cover, an aperture in said body member, and lock receiving tab means extending outwardly from the container cover so that a lock may be inserted through said aperture in said body member and engage said lock receiving tab means, said aperture including a generally vertical slot formed in said generally planar portion and in said upper end and a cross slot generally aligned with said tab means when said body member is pivoted to a closed position.

2. A latch assembly according to claim 1 further comprising an aperture in said tab means, said vertical slot in said upper end being aligned with said aperture in said tab means.

3. A latch assembly according to claim 1 further comprising a second aperture in said body member.

4. A latch assembly according to claim 3 further comprising an aperture in said tab means, said second aperture in said body member being generally aligned with said aperture in said tab means when said body member is pivoted to a closed position.

5. A latch assembly according to claim 3 further comprising a notch in said lower end of said body member, said notch being aligned with said second aperture.

6. A latch assembly according to claim 3 wherein said second aperture is in said lower end of said body member and aligned with said tab means.

7. A latch assembly according to claim 1 further comprising rib means on the container cover to be engaged by said lug means.

8. A latch assembly according to claim 7 wherein said rib means is interrupted and said tab means extends outwardly from the container cover at the point of interruption of said rib means.

9. A latch assembly according to claim 1 wherein said means to pivot includes axle members extending outwardly from said body member and bearing hub means on the container base portion to pivotally receive said axle members.

10. A container comprising a base portion having side walls and end walls, a recess in at least one of said walls, a cover for closing the top of said base portion, a latch member positioned in said recess and having an upper end and a lower end, means to pivot said lower end of said latch member with respect to said one of said walls, lug means proximate said upper end of said latch member to engage said cover, lock receiving tab means extending outwardly from said cover, and an aperture in said latch member positioned so that a lock may be inserted through said aperture and engage said tab means.

11. A container according to claim 10 wherein said aperture is positioned in said latch member so as to be adjacent to said tab means when said latch member is pivoted to a closed position with said lug means engaging said cover.

12. A container according to claim 10 further comprising a recess in said cover aligned with said recess in said one of said walls, said latch member being positioned in said recess in said cover when pivoted to a closed position with said lug members engaging said cover.

13. A container according to claim 10 wherein said means to pivot includes bearing hubs extending from said one of said walls and into said recess, and axle means extending from said latch member to be pivotal in said bearing hubs.

14. A container according to claim 10 further comprising a recess in said cover, and rib means extending across said recess to be engaged by said lug means.

15. A container according to claim 14 wherein said rib means is interrupted and said tab means extends outwardly from the container cover at the point of interruption of said rib means.

16. A container according to claim 10 wherein said latch member is generally C-shaped having a generally planar portion between said upper and lower ends, said upper and lower ends being generally curvilinear.

17. A container according to claim 16 wherein said aperture includes a generally vertical slot formed in said generally planar portion and in said upper end.

18. A container according to claim 17 wherein said aperture also includes a cross slot generally aligned with said tab means when said latch member is pivoted to a closed position.

19. A latch assembly according to claim 17 further comprising an aperture in said tab means, said vertical slot in said upper end being aligned with said aperture in said tab means.

20. A container according to claim 10 further comprising an aperture in said tab means, a second aperture in said latch member generally aligned with said aperture in said tab means.

21. A container according to claim 20 further comprising a notch in said lower end of said latch member aligned with said second aperture.

22. A container comprising a base portion having side walls and end walls, a cover for closing the top of said base portion, a generally C-shaped latch member having a generally planar portion between generally curvilinear upper and lower ends, means to pivot said lower end of said latch member with respect to one of said walls, lug means proximate said upper end of said latch member to engage said cover, lock receiving tab means extending outwardly from said cover, and an aperture in said latch member, said aperture including a generally vertical slot formed in said generally planar portion and in said upper end and a cross slot generally aligned with said tab means so that a lock may be inserted through said aperture and engage said tab means when said latch member is pivoted to a closed position.

* * * * *